US008235497B2

(12) United States Patent
Momose

(10) Patent No.: US 8,235,497 B2
(45) Date of Patent: Aug. 7, 2012

(54) LIQUID EJECTION APPARATUS AND METHOD OF EJECTING LIQUID USING THE SAME

(75) Inventor: Kaoru Momose, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 229 days.

(21) Appl. No.: 12/818,257

(22) Filed: Jun. 18, 2010

(65) Prior Publication Data

US 2010/0253725 A1 Oct. 7, 2010

Related U.S. Application Data

(62) Division of application No. 11/094,515, filed on Mar. 31, 2005, now abandoned.

(30) Foreign Application Priority Data

Mar. 31, 2004 (JP) ..... 2004-104322
Mar. 29, 2005 (JP) ..... 2005-094754

(51) Int. Cl.
*B41J 2/165* (2006.01)

(52) U.S. Cl. ..... 347/29; 347/32; 347/35

(58) Field of Classification Search ..... 347/29, 347/30, 32, 34–36
See application file for complete search history.

(56) References Cited

U.S. PATENT DOCUMENTS 5,896,143 A 4/1999 Matsui et al.
6,042,218 A 3/2000 Nakahara
6,168,259 B1 1/2001 Capurso
6,234,604 B1 5/2001 Kawakami et al.
2002/0041303 A1* 4/2002 Yoshinaga ..... 347/22
2003/0234832 A1* 12/2003 Uchida ..... 347/36
2004/0046829 A1 3/2004 Taguchi et al.

FOREIGN PATENT DOCUMENTS

JP 6-79877 A 3/1994
JP 10-146987 A 6/1998
JP 2000-351205 A 12/2000
JP 2001-301201 A 10/2001
JP 2002-86760 A 3/2002
JP 2002-166575 A 6/2002
JP 2002-225301 A 8/2002

* cited by examiner

*Primary Examiner* — Matthew Luu
*Assistant Examiner* — Henok Legesse
(74) *Attorney, Agent, or Firm* — Sughrue Mion, PLLC

(57) ABSTRACT

A target medium is placed on a first region. A liquid absorbing member is placed in at least a second region which is adjacent to the first region. A liquid ejection head is movable above the first region and the second region, and provided with a plurality of liquid ejecting sections from which liquid droplets are ejected. Each of the liquid ejecting sections is configured so as to eject at least one liquid droplet toward the target medium when it is placed above the first region, and to flush a prescribed amount of liquid toward the liquid absorbing member when it is placed above the second region. The liquid ejecting sections are arranged such that at least one of the liquid ejecting sections can be placed above the first region when another one of the liquid ejecting sections is placed above the second region.

1 Claim, 14 Drawing Sheets

FIG. 9

| OPERATION MODE | EXECUTION INTERVAL | AMOUNT OF EJECTED INK PER 1 seg | REPETITIVE NUMBER | TOTAL AMOUNT OF INK FLUSHED BY SINGLE FLUSHING OPERATION |
|---|---|---|---|---|
| HIGH-RESOLUTION MODE | 10 SEC | 13 ng | 90 seg | 1170 ng |
| NORMAL MODE | 10 SEC | 26 ng | 45 seg | 1170 ng |
| DRAFT MODE | 10 SEC | 39 ng | 30 seg | 1170 ng |

FIG. 10

| OPERATION MODE | EXECUTION INTERVAL | AMOUNT OF EJECTED INK PER 1 seg | REPETITIVE NUMBER | TOTAL AMOUNT OF INK FLUSHED BY SINGLE FLUSHING OPERATION |
|---|---|---|---|---|
| HIGH-RESOLUTION MODE | 5 SEC | 13 ng | 45 seg | 585 ng |
| HIGH-RESOLUTION MODE | 2 SEC | 13 ng | 18 seg | 234 ng |

LIQUID EJECTION APPARATUS AND METHOD OF EJECTING LIQUID USING THE SAME

This is a divisional of application Ser. No. 11/094,515 filed Mar. 31, 2005. The entire disclosure of the prior application, application Ser. No. 11/094,515 is considered part of the disclosure of the accompanying divisional application and is hereby incorporated by reference.

BACKGROUND OF THE INVENTION

The present invention relates to a liquid ejection apparatus for ejecting liquid toward a target and a method of ejecting liquid using such a liquid ejection apparatus.

An ink jet recording apparatus as an exemplary liquid ejection apparatus is equipped with an ink jet recording head. The ink jet recording head is provided with a large number of nozzles for ejecting ink toward a recording sheet or the like.

Since each nozzle has an aperture, ink is exposed to the air and its solvent such as water evaporates gradually. If that part of the ink which is in the vicinity of the meniscus which is a free surface of the ink in the nozzle is increased in viscosity because of the evaporation of the ink solvent, an ejected ink droplet may fly in an erroneous direction because of a drag by the viscosity-increased ink or a nozzle may clog up.

To prevent various kinds of trouble due to such increase in ink viscosity, what is called flushing operations are performed in which ink is ejected from each nozzle at prescribed intervals (refer to Patent document 1, for example).

For example, as shown in FIG. 1 of Japanese Patent Publication No. 2002-166575A, an ink absorbing member is disposed at a position far from a region where a recording sheet is disposed (referred as a recording region) and a flushing region is established there. A flushing operation is performed in such a manner that the ink jet recording head is moved to the flushing region and ink is ejected there.

However, where the flushing region is provided at a position far from the recording region, the ink jet recording head is moved from the recording region to the flushing region every time a flushing operation is performed.

This means a problem that time is taken for the ink jet recording head to make such a movement to increase a time period required for recording, that is, the use of time is inefficient. The efficiency of use of time in connection with recording is particularly low when recording is performed on a narrow sheet such as a postcard, because a long distance exists between the flushing region and the region where a postcard or the like is disposed.

SUMMARY OF THE INVENTION

It is therefore an object of the invention to provide a liquid ejection apparatus which enables an efficient flushing operation, and a method of ejecting liquid using such a liquid ejection apparatus.

In order to achieve the above object, according to the invention, there is provided a liquid ejection apparatus, comprising:

a first region, on which a target medium is placed;

a second region, adjacent to the first region;

a liquid absorbing member, placed in at least the second region; and a liquid ejection head, being movable above the first region and the second region, and provided with a plurality of liquid ejecting sections from which liquid droplets are ejected, wherein:

each of the liquid ejecting sections is configured so as to eject at least one liquid droplet toward the target medium when it is placed above the first region, and to flush a prescribed amount of liquid toward the liquid absorbing member when it is placed above the second region; and the liquid ejecting sections are arranged such that at least one of the liquid ejecting sections can be placed above the first region when another one of the liquid ejecting sections is placed above the second region.

Preferably, each of the liquid ejecting sections includes an array of nozzle orifices from which liquid droplets are ejected.

Preferably, a signal for causing each of the liquid ejecting sections to eject at least one liquid droplet with respect to a unit area on the target medium is repetitively applied to the liquid ejection head to flush the prescribed amount of liquid.

Preferably, the liquid ejection head is configured such that liquid droplets are ejected from one of the liquid ejecting sections while the prescribed amount of liquid is flushed from another one of the liquid ejecting sections.

Preferably, the prescribed amount of liquid from at least one of the liquid ejecting sections while the liquid ejection head is moved.

Preferably, a timer counts time, and each of the liquid ejecting sections flushes the prescribed amount of liquid every time when the timer counts a prescribed time period.

Preferably, a timer which counts time, and the prescribed amount of liquid is increased in accordance with an increase of the time counted.

BRIEF DESCRIPTION OF THE DRAWINGS

The above objects and advantages of the present invention will become more apparent by describing in detail preferred exemplary embodiments thereof with reference to the accompanying drawings, wherein:

FIGS. 9 and 10 are tables for explaining flushing operations performed by the ink jet recording apparatus of FIG. 1;

DETAILED DESCRIPTION OF THE INVENTION

Embodiments of the present invention will be hereinafter described in detail with reference to the accompanying drawings.

Figure 1:
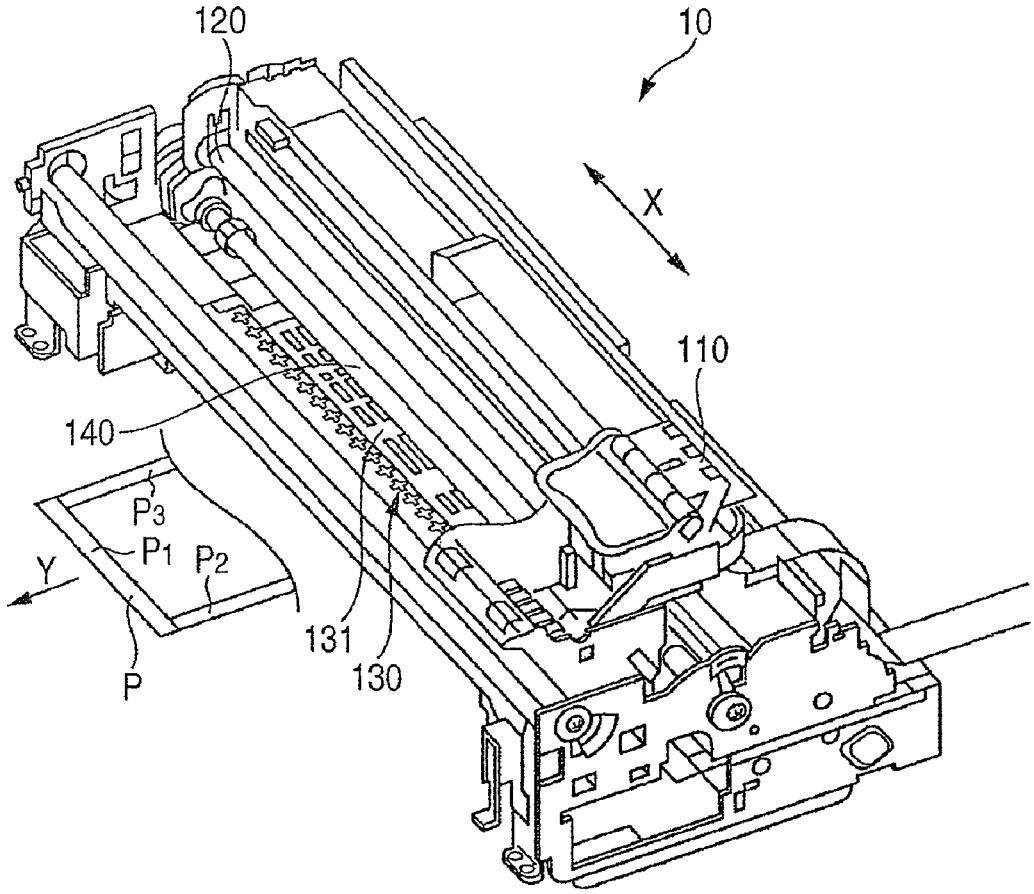
FIG. 1 is a schematic perspective view of an ink jet recording apparatus according to a first embodiment of the invention.

As shown in FIG. 1, an ink jet recording apparatus (hereinafter referred to as "recording apparatus") 10 according to a first embodiment of the invention is equipped with a carriage 110 which carries an ink jet recording head (hereinafter referred to as "recording head") 100 for ejecting liquid such as ink (described later with reference to FIG. 3).

The carriage 110 is movable in an X direction indicated by an arrow along a guide shaft 120. Therefore, the recording head 100 that is mounted on the carriage 110 is likewise moved in the arrowed X direction.

The recording apparatus 10 is equipped with a platen 130 on which a target such as a recording sheet P is to be placed. The recording apparatus 10 is also equipped with a sheet feeding roller 140 for moving a recording sheet P in, for example, a Y direction indicated by an arrow.

A recording sheet P to be fed in the arrowed Y direction by the sheet feeding roller 140 is placed on the platen 130. Printing or the like is performed on the recording sheet P in such a manner that the recording head 100 on the carriage 110 ejects ink while the carriage 110 is moved in the arrowed X direction with respect to the thus-placed recording sheet P.

The platen 130 is provided with an absorbing member 131 for absorbing ink that is ejected from the recording head 100. The absorbing member 131 is a porous material such as a sponge. That is, the absorbing member 131 absorbs ink that is ejected so as to reach the outside of a recording sheet P when the recording apparatus 10 performs recording on a peripheral portion of the recording sheet P (what is called marginless recording).

The marginless recording will be hereinafter described with reference to FIGS. 2A to 2C.

Figure 2A:
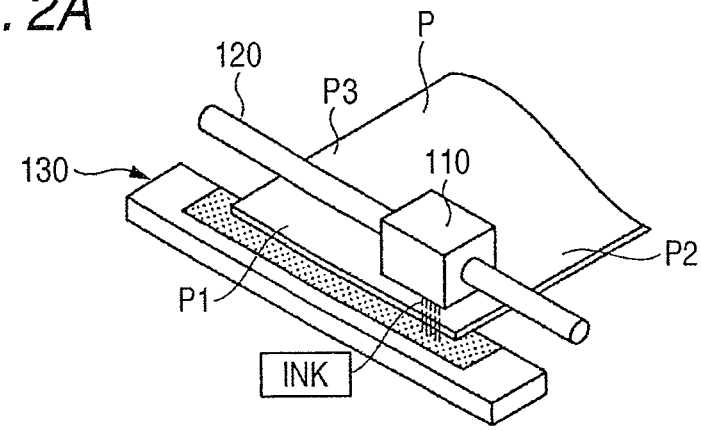
FIGS. 2A to 2C are schematic perspective views showing a marginless recording performed by the ink jet recording apparatus of FIG. 1.
Figure 2B:
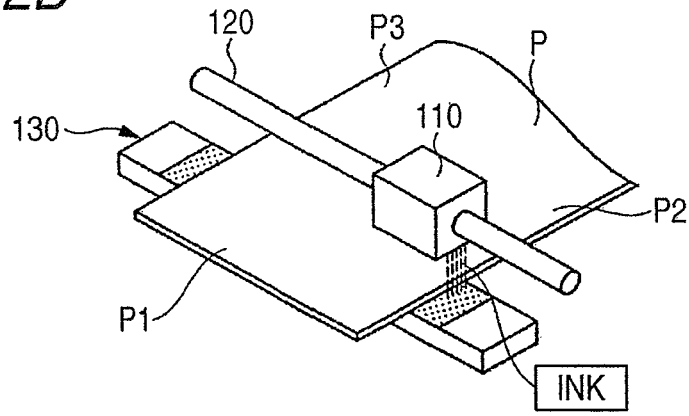
Figure 2C:
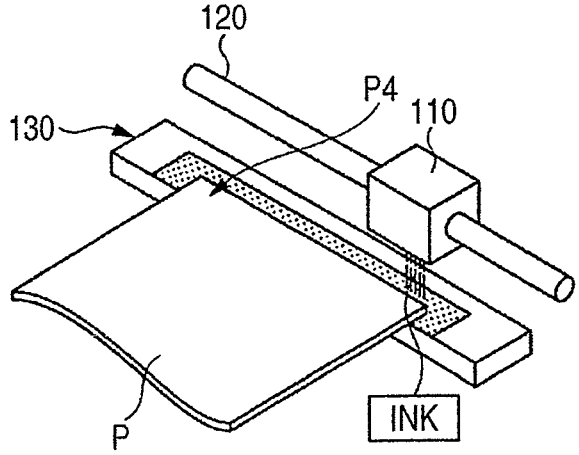

First, as shown in FIG. 2A, a top end portion P1 of a recording sheet P is placed on the platen 130. In this state, the recording head 100 is disposed so as to stride the top end portion P1 of the recording sheet P and ink is ejected, whereby marginless recording is effected on the top end portion P1. At this time, ink that is ejected from the recording head 100 so as to reach the outside of the top end portion P1 of the recording sheet P is absorbed by the absorbing member 131 of the platen 130.

Then, marginless recording is performed on a left end portion P2 and a right end portion P3 of the recording sheet P. More specifically, as shown in FIG. 2B, the recording head 100 is disposed so as to stride the left end portion P2 of the recording sheet P and ink is ejected, whereby marginless recording is effected on the left end portion P2. At this time, ink that is ejected so as to reach the outside of the left end portion P2 is absorbed by the absorbing member 131 of the platen 130.

Marginless recording on the right end portion P3 in the same manner as on the left end portion P2. Ink that is ejected so as to reach the outside of the right end portion P3 is absorbed by the absorbing member 131 of the platen 130.

Then, marginless recording is performed on a bottom end portion P4 of the recording sheet P. More specifically, the bottom end portion P4 of the recording sheet P is placed on the platen 130 as shown in FIG. 2C and the recording head 100 is disposed so as to stride the bottom end portion P4 of the recording sheet P. Ink is then ejected, whereby marginless recording is effected on the bottom end portion P4. At this time, ink that is ejected so as to reach the outside of the bottom end portion P4 is absorbed by the absorbing member 131 of the platen 130.

The marginless recording on the recording sheet P is performed in the above-described manner. Since ink that is ejected so as to reach the outside of the edges of the recording sheet P is absorbed by the absorbing member 131, and will not be landed and adhered on the platen 130. This prevents staining or the like of a recording sheet P that is supplied by the sheet feeding roller 140 shown in FIG. 1 in the next recording operation.

Figure 3:
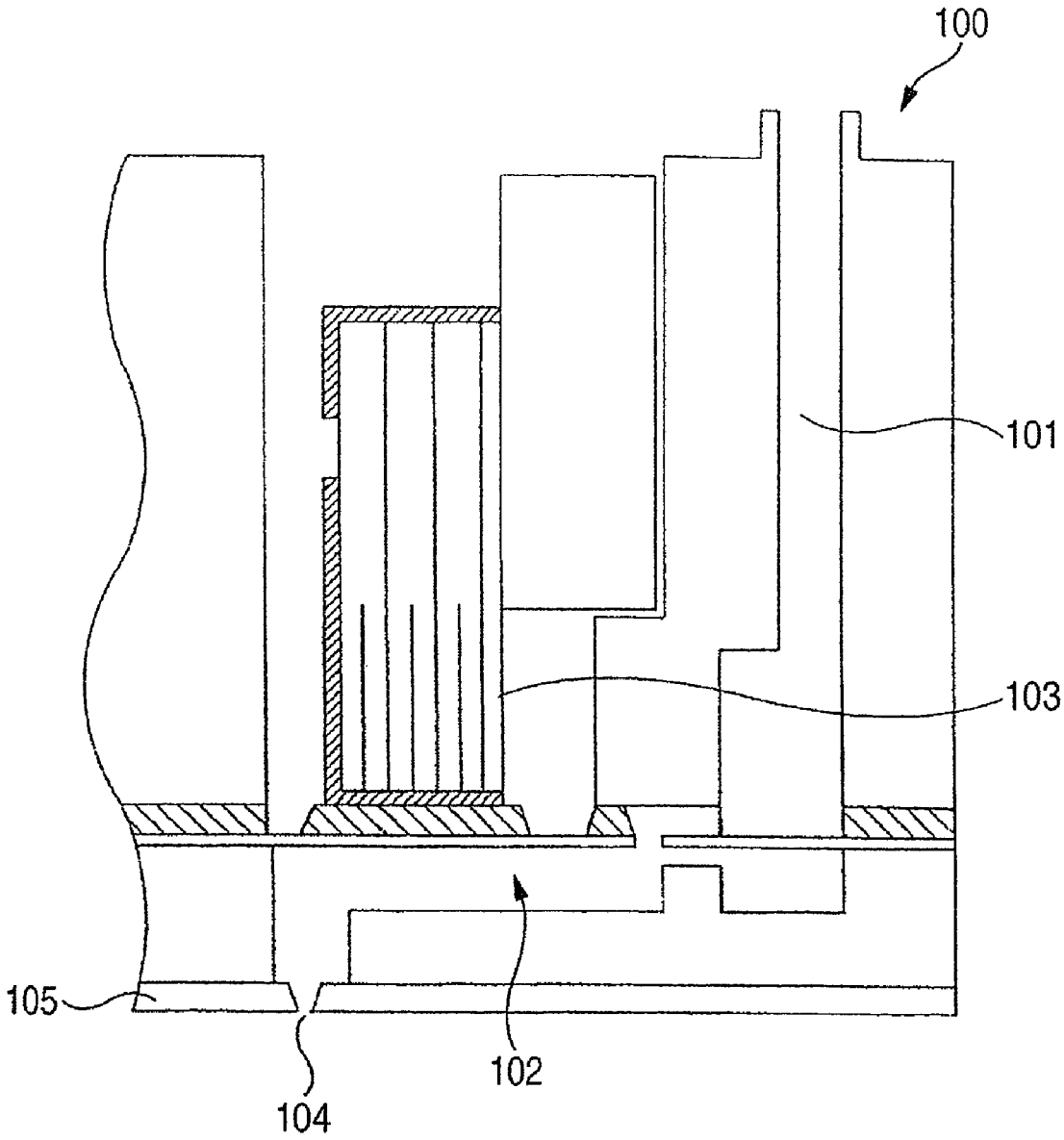
FIG. 3 is a schematic section view of an essential part of an ink jet recording head in the ink jet recording apparatus of FIG. 1.

As shown in FIG. 3, the recording head 100 has an ink passage 101, which, for example, guides ink that is supplied from an ink cartridge (not shown) that houses ink. Ink that has been guided by the ink passage 101 is introduced into pressure chambers 102. Piezoelectric vibrators 103 are disposed above the pressure chambers 102. A nozzle plate 105 having nozzles 104 for ejecting ink is disposed below the pressure chambers 102.

That is, contraction and expansion of a piezoelectric vibrator 103 that are caused by a voltage applied thereto cause the ink in the associated pressure chamber 102 to be ejected from the associated nozzle 104.

Figure 4:
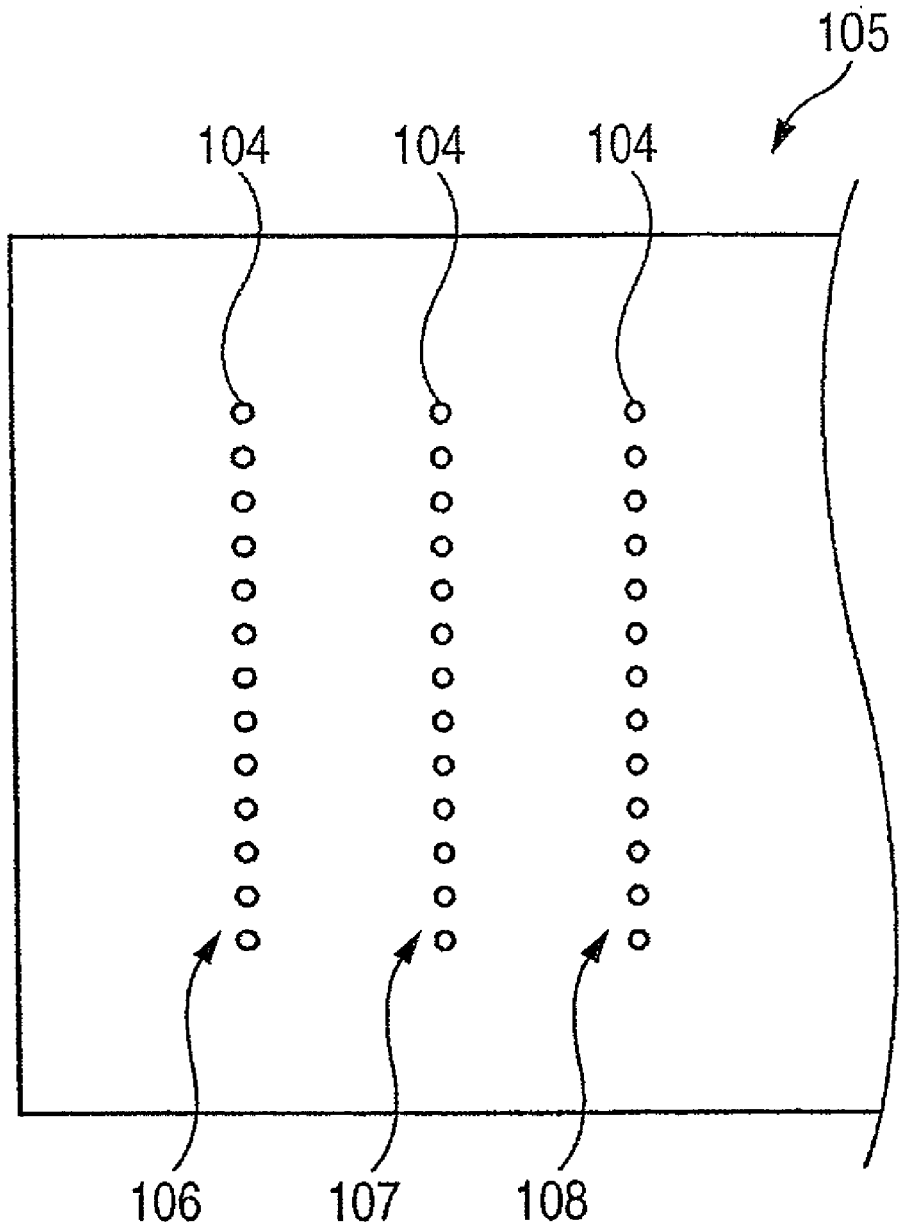
FIG. 4 is a schematic plan view of a nozzle plate in the ink jet recording head of FIG. 3.

As shown in FIG. 4, plural nozzles 104 are arranged in lines in the nozzle plate 105 so as to form plural nozzle arrays such as a nozzle array 106, a nozzle array 107, and a nozzle array 108 are formed.

In each of the nozzles 104 shown in FIG. 3, ink that is supplied from the pressure chamber 102 forms a meniscus. However, the nozzles 104 are exposed to the air as shown in FIGS. 3 and 4. Therefore, a solvent such as water of the ink in each nozzle 104 evaporates gradually and hence the viscosity of the ink increases. If a piezoelectric vibrator 103 shown in FIG. 3 is contracted and expanded in this state to eject ink, an ejected ink droplet may fly in an erroneous direction. Or a nozzle 104 clogs up to cause an ink ejection failure or the like.

To prevent such trouble, what is called flushing operations are performed in which the recording head 100 ejects ink from the nozzles 104 at prescribed intervals. In this embodiment, flushing operations are performed such that ink droplets are ejected toward the absorbing member 131 of the platen 130 shown in FIG. 1. This means that the absorbing member 131 of the platen 130 is adapted to absorb ink that is ejected from the nozzles 104 by flushing.

Figure 5:
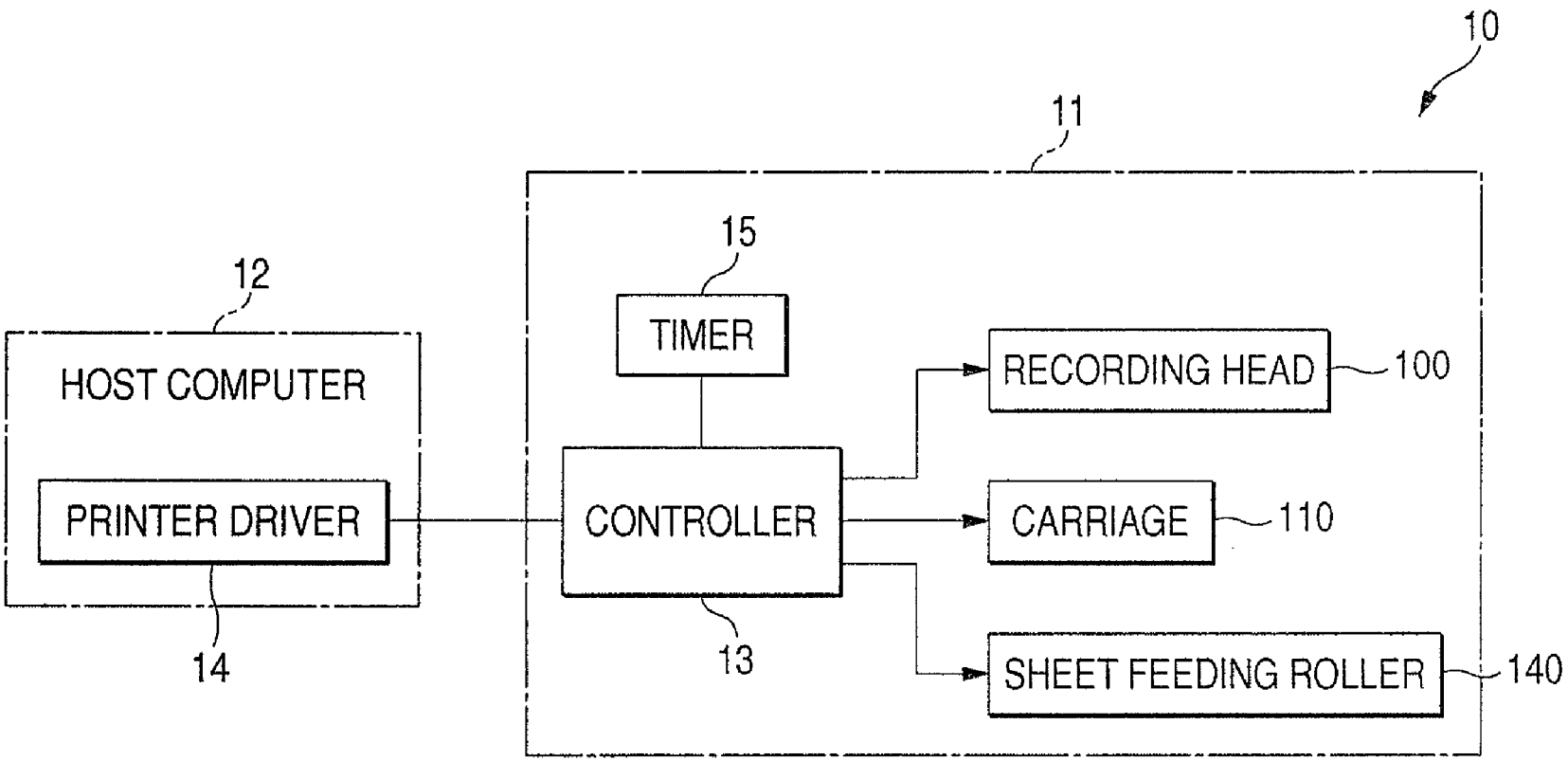
FIGS. 5 and 6 are diagrams showing a control configuration of the ink jet recording apparatus of FIG. 1.

As shown in FIG. 5, an apparatus main body 11 of the recording apparatus 10 is connected to a host computer 12. The apparatus main body 11 has a controller 13 and the host computer 12 has a printer driver 14. Therefore, the controller 13 is connected to the printer driver 14 via a local printer cable or a communication network.

The controller 13 is connected to not only a timer 15 but also the recording head 100, the carriage 110, the sheet feeding roller 140, etc.

The printer driver 14 incorporates software to be used for sending, to the individual components of the recording apparatus 10, commands for performance of recording, a flash operation, etc. According to the software in the printer driver 14, the controller 13 controls recording and a flushing operation of the recording head 100 and controls operation of the carriage 110, a sheet feeding roller 140, etc.

Figure 6:
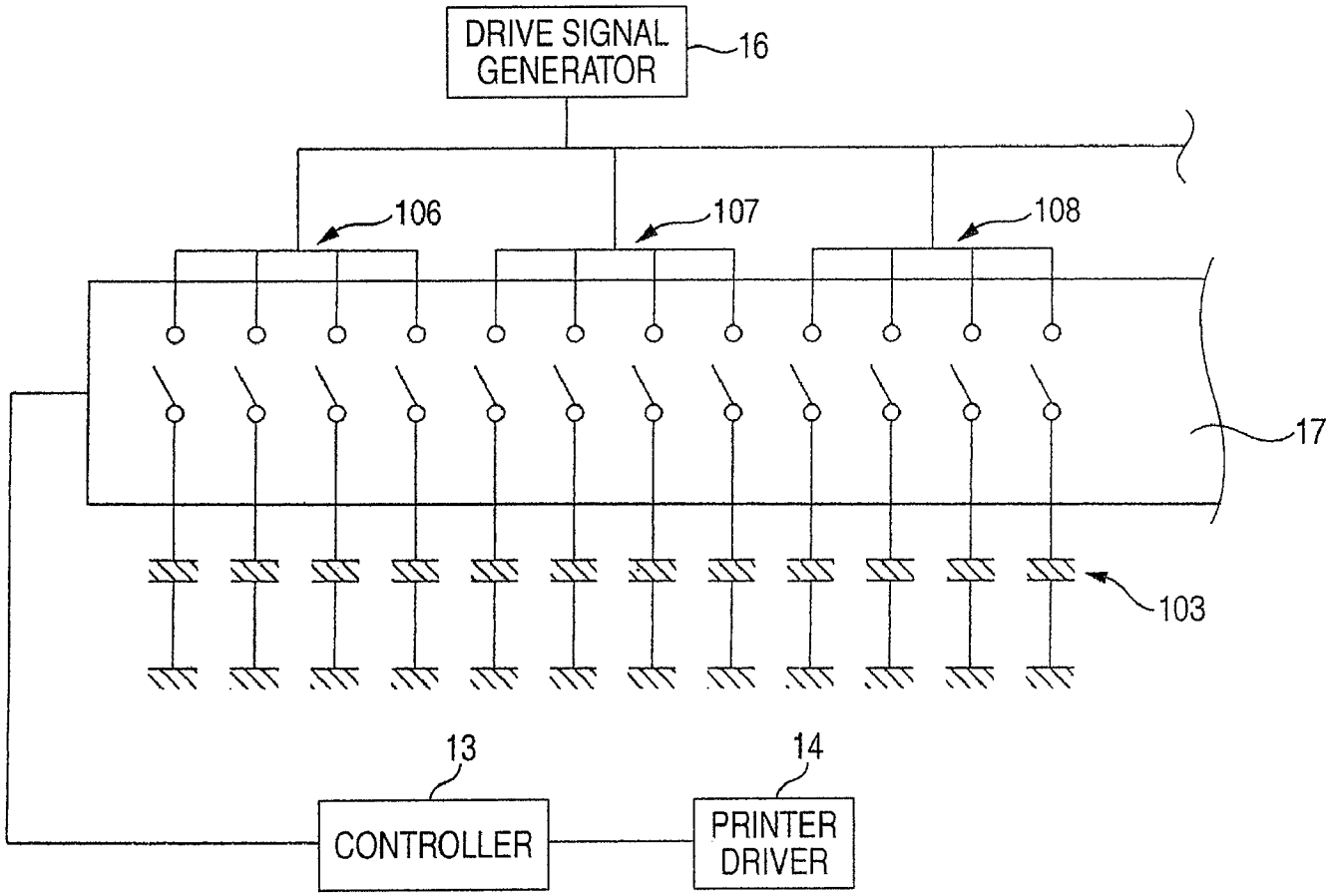

As shown in FIG. 6, the nozzles of the nozzle array 106, the nozzle array 107, and the nozzle array 108 that are formed in the nozzle plate 105 shown in FIG. 4 are provided with the respective piezoelectric vibrators 103, whereby the eject of ink from the individual nozzles 104 can be controlled. The nozzle array 106, the nozzle array 107, and the nozzle array 108 are connected to a drive signal generator 16 and are provided with transfer gates (TG) 17 as switching devices. With this configuration, the controller 13 can control the eject of ink from the nozzles 104 of the nozzle array 106, the nozzle array 107, and the nozzle array 108 via the drive signal generator 16 according to instructions from the printer driver 14.

Figure 7:
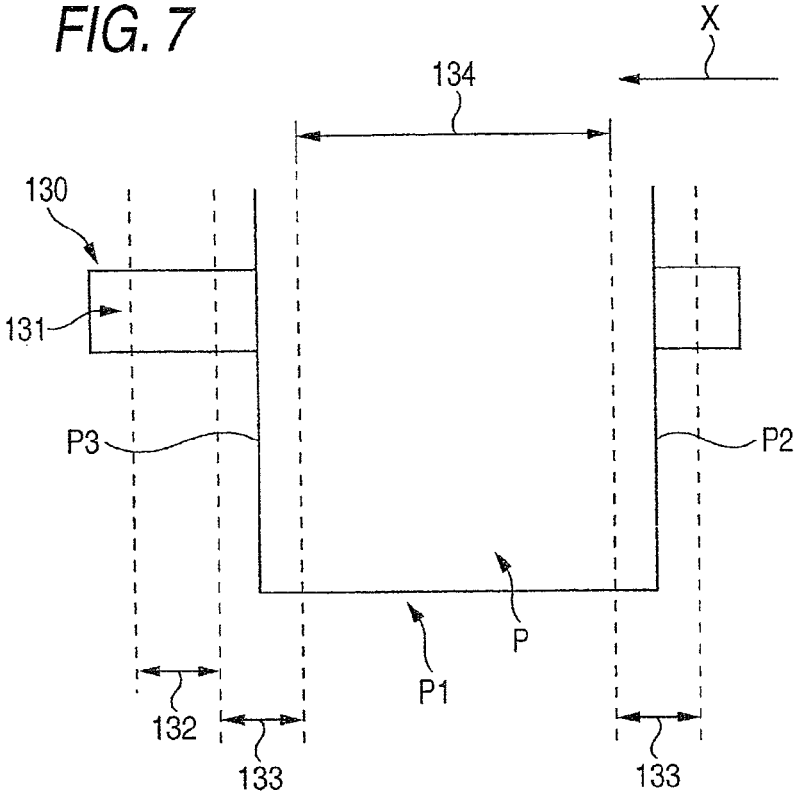
FIG. 7 is a diagram showing arrangement of a recording region, marginless recording regions and a flushing region in the ink jet recording apparatus of FIG. 1.

As shown in FIG. 7, a recording region 134 where to place a recording sheet P is defined on the platen 130. Two marginless recording regions 133 where to perform marginless recording shown in FIG. 2 on the left end portion P2 and the right end portion P3 of a recording sheet P are defined in the respective sides of the recording region 134. Further, a flushing region 132 where the recording head 100 is to perform a flushing operation is provided adjacent to the marginless recording region 133 for the right end portion P3.

Figure 8:
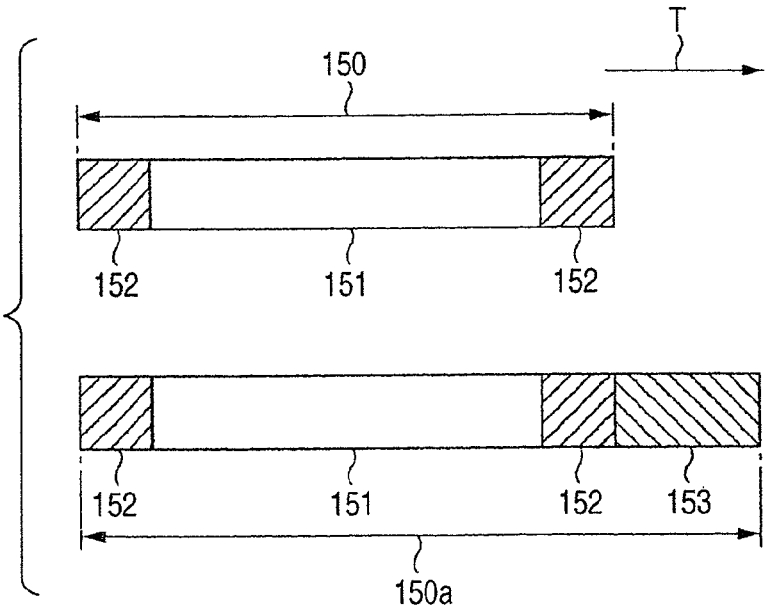
FIG. 8 is a diagram showing data structures of image data used in the configuration shown in FIG. 7.

FIG. 8 shows data structures of first image data 150 and second image data 150*a* in the printer driver 14, respectively corresponding a single primary scanning without a flushing operation and a single primary scanning with a flushing operation. Time elapses from left to right as indicated by an arrow T. That is, left-side marginless recording data 152 is for recording operation to be performed in the right-side marginless recording region 133 for the left end portion P2 of the recording sheet P. Recording data 151 is for recording operation to be performed in the recording region 134. Right-side marginless recording data 152 is for recording operation to be performed in the left-side marginless recording region 133 for the right end portion P3 of the recording sheet P.

The first image data 150 corresponding to a single primary scanning of the recording head 100 is used in the normal recording operation. However, since the nozzles 104 are exposed to the air during the recording to cause drying or the like of the ink in the nozzles 104, a flushing operation needs to be performed every prescribed time.

Therefore, when a lapse of a prescribed time has been detected by the timer 15, flushing data 153 is appended to the right-side marginless recording data 152. The flushing data 153 is for flushing operation to be performed in the flushing region 132 that is adjacent to the left-side marginless recording region 133 shown in FIG. 7.

Since flushing data 153 are appended to the first image data 150 to generate the second image data 150*a* when a flushing operation is to be performed, the recording head 100 can perform a flushing operation immediately after performance of a marginless recording in the left-side marginless recording region 133 shown in FIG. 7.

Therefore, it is not necessary to move the recording head 100 to a conventional flushing region that is far from the recording region 134, which solves the problem that this movement requires an extra recording time. The efficiency of use of time in connection with recording can thus be increased.

In the conventional recording apparatus, flushing operations repetitively are executed at a fixed interval during recording operation. That is, every time when a prescribed time period elapses, the recording head is moved to the flushing region which is far from the recording region to flush a prescribed amount of ink. For example, the fixed interval is set to 10 seconds and the prescribed amount of ink (total amount of ink flushed by a single flushing operation) is set to 1170 ng (nanograms).

As described the above, when the timer 15 detects that the prescribed time period elapses, the flushing data 153 is appended to the first image data 150 to generate the second image data 150*a*. In this embodiment, as a drive signal for causing the recording head 100 to flush the above prescribed amount of ink, the drive signal for causing the recording head 100 to perform recording operation is used.

Specifically, as shown in FIG. 9, the recording operation is executed by one of a plurality of operation modes including a high-resolution mode, a normal mode, and a draft mode in accordance with the purpose of recording. For example, in the high-resolution mode, 13 ng of ink is ejected by using a drive signal for causing the recoding head 100 to perform recording with respect to one pixel. In FIG. 9, it is represented by using a unit of "1 seg". It should be noted that ink ejection corresponding to 1 seg is not necessarily a single ejection of an ink droplet. In this case, the ejection of 13 ng of ink is repetitively performed for 90 times (90 seg), thereby flushing 1170 ng of total amount of ink.

Similarly, in the normal mode, a drive signal for causing the recording head 100 to eject 26 ng of ink is repetitively applied for 45 times (45 seg), thereby flushing 1170 ng of total amount of ink. In the draft mode, a drive signal for causing the recording head 100 to eject 39 ng of ink is repetitively applied for 30 times (30 seg), thereby flushing 1170 ng of total amount of ink.

In the conventional configuration, upon the execution of the flushing operation, not only the recording head is moved to the flushing region which is far from the recording region but also it is necessary to supply a drive signal for causing the recording head to perform the flushing operation which is different from a drive signal for causing the recording head to perform the recording operation. However, in this embodiment, not only the flushing region 132 at which the recording head 100 (more specifically, the nozzle array subjected to the flushing operation) is placed to perform the flushing operation is situated adjacent to the recording regions 133, 134 but also the drive signal for the recording operation can be utilized as the drive signal for the flushing operation. Accordingly, the whole of the recording operation can be efficiently and speedily executed.

The ink amount ejected per 1 seg shown in FIG. 9 is identical with an ink amount ejected when a drive signal for recording a large dot in each of the operation modes is used. Taking the high-resolution mode as an example, it may be represented that 90 times of the large dot recording operations are performed in the flushing region 132.

With the above configuration, even if the recording operation is performed in any one of the operation modes shown in FIG. 9, the flushing data 153 can be generated by using the drive signal (recording data) for recording a large dot defined in the outstanding operation mode and merely designating the number of repetition (number of seg). Hence, the shift of operation (that is, recording operation to the flushing operation) can be smoothly and speedily completed. Taking the normal mode as an example, data which represents that recording data for the large-dot recording (26 ng of ink is ejected per 1 seg) is repeated for 45 times is set as the flushing data 153.

In addition, in comparison with a case where a drive signal for causing the recording head 100 to record a medium dot or a small dot, the flash of the prescribed amount of ink (here, 1170 ng) can be completed with fewer repetition number (number of seg). Since the flushing operation is executed while the recording head 100 is moved, it is possible to reduce the amount of movement of the recording head 100 until the flushing operation is completed. Accordingly, the recording head 100 can be quickly returned to the recording regions 133, 134 to again perform the recording operation. Therefore, the whole of the recording operation can be efficiently and speedily executed.

As shown in FIG. 10, there may configured such that the interval between the subsequent flushing operations is shortened in the same operation mode and the total amount of ink flushed in the single flushing operation is accordingly reduced. In the examples as shown, under a condition that the recording operation of the high-resolution mode is performed, the interval is set to 5 seconds or 2 seconds, and the total amount of ink to be flushed in the single flushing operation is set to 585 ng or 234 ng, respectively.

Also in this case, the flushing data 153 can be generated by merely designating the repetitive number of the application of the drive signal for causing the recording head 100 to record a large dot. Specifically, in a case where the flushing operation is executed every 5 seconds, the repetitive number is set to 45 times. Namely, even in a case where the way of executing the flushing operations is changed while the same operation mode is unchanged, it is not necessary to provide a large change with respect to the data format and the driving method for the recording head 100. Accordingly, the whole of the recording operation can be efficiently and speedily executed. The above explanations are applicable to the normal mode and the draft mode.

Figure 11:
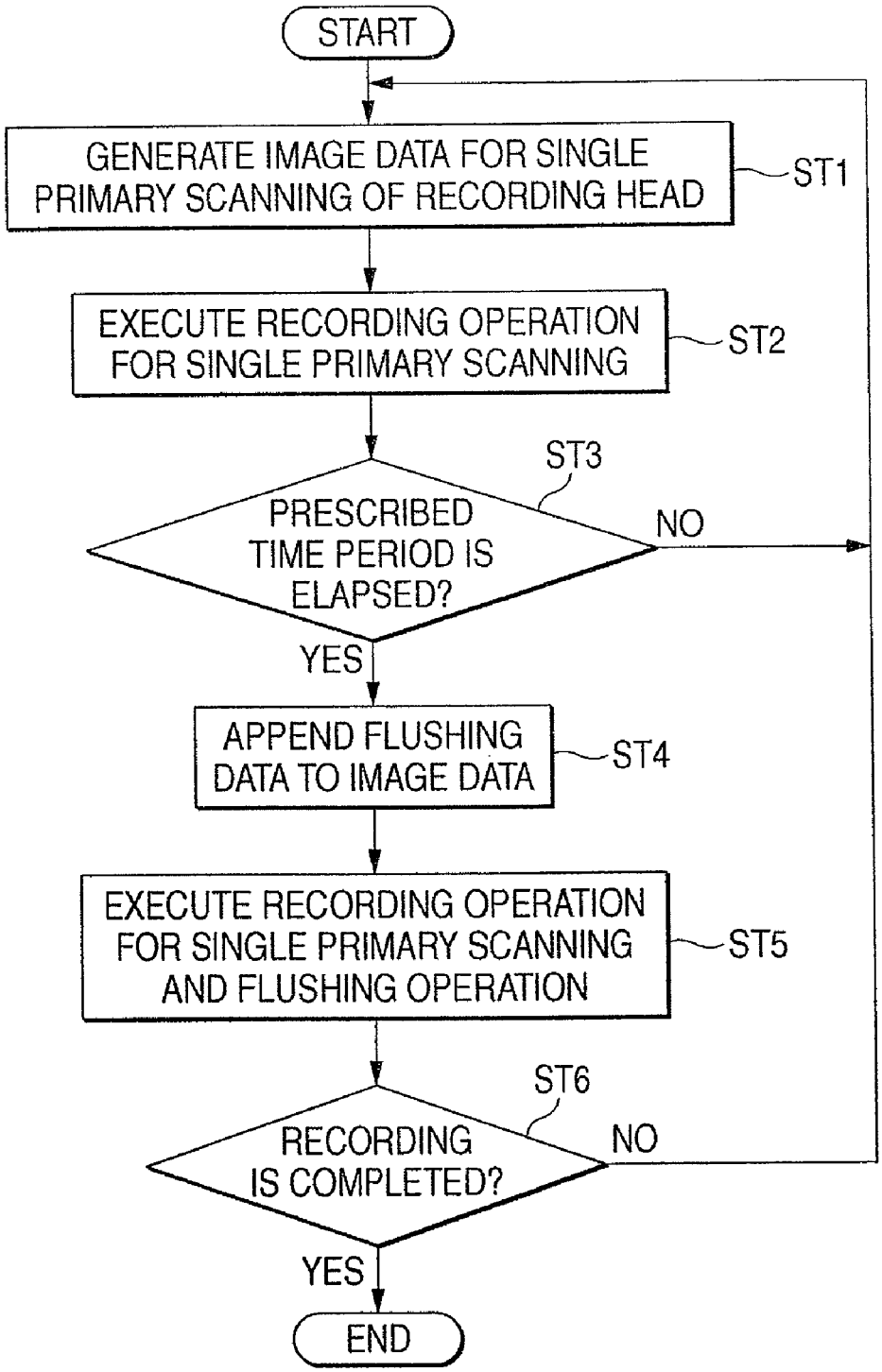
FIG. 11 is a flow chart showing operations performed by the ink jet recording apparatus of FIG. 1.

As shown in FIG. 11, when the recording apparatus 10 of FIG. 1 performs recording on a recording sheet P, first, image data for a single primary scanning of the recording head 100 is generated (step ST1). More specifically, as in the case of the first image data 150 shown in FIG. 8, marginless recording data 152 are provided before and after recording data 151. The recording apparatus 10 performs recording for the single primary scanning by controlling the recording head 100 on the basis of the thus-generated first image data 150 (step ST2).

Figure 12A:
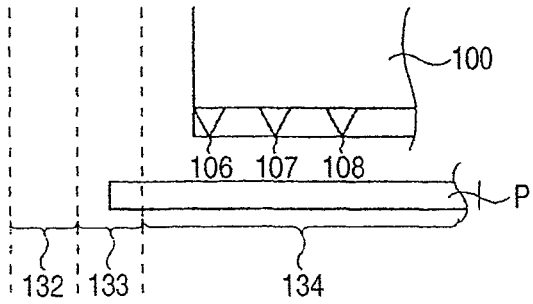
FIGS. 12A to 12D are diagrams showing the operations performed by the ink jet recording apparatus of FIG. 1.

At this time, a recording sheet P and the nozzle arrays 106 to 108 of the recording head 100 are arranged as shown in FIG. 12A. That is, all of the nozzle arrays 106 to 108 are located in the recording region 134 of the recording sheet P and hence are in such a state as to be able to eject ink toward the recording sheet P.

Figure 12B:
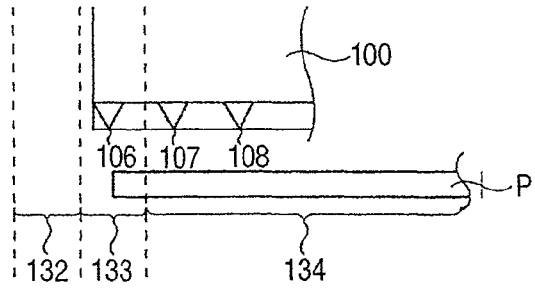

Then, as shown in FIG. 12B, as the carriage 110 is moved, the nozzle array 106 is moved leftward in FIG. 12. As a result, the nozzle array 106 reaches the left-side marginless recording region 133 shown in FIG. 7, where marginless recording is performed on the right end portion P3 of the recording sheet P. In this state, the nozzle array 106 performs marginless recording in the left-side marginless recording region 133 and the nozzle arrays 107 and 108 perform recording in the recording region 134.

Then, time information is acquired from the timer 15 and it is judged whether a prescribed time has elapsed (step ST3). That is, it is judged whether an ink ejection failure or the like will possibly occur due to drying or the like of ink in the nozzles 104 that is caused by exposure of the meniscuses of the ink to the air.

If the prescribed time has elapsed, the recording head 100 is subjected to a flushing operation to prevent an ink ejection failure or the like. That is, second image data 150*a* is generated by appending flushing data 153 to the first image data 150 (step ST4).

Figure 12C:
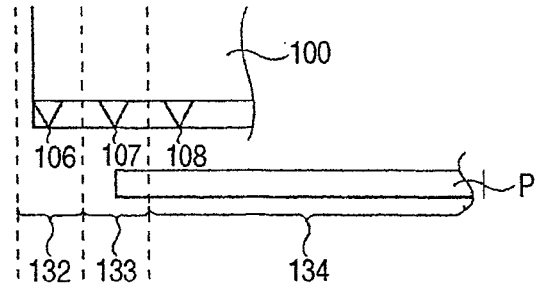

Then, recording for a single primary scanning is performed with the second image data 150*a* (step ST5). More specifically, as shown in FIG. 12C, a flushing operation is performed when the nozzle array 106 has been located over the flushing region 132 shown in FIG. 7 after completion of the marginless recording. That is, only the nozzle array 106 performs the flushing operation in accordance with the flushing data 153. At this time, the ink ejection mode of the nozzle array 106 is switched from the recording mode to the flushing mode. However, as described the above, since the flushing data 153 can be easily generated by merely designating the repetitive number of application of the drive signal for causing the recording head 100 to record a large dot, such mode switching can be smoothly and speedily completed.

At the same time, since the similar image data 150*a* are also set with respect to the nozzle arrays 107 and 108 with time differences, the nozzle array 107 performs marginless recording in the left-side marginless recording region 133, and the nozzle array 108 performs recording in the recording region 134. That is, the nozzle arrays 106, 107, and 108 are configured to eject different amounts of ink. The nozzle array 106, which has already completed a recording operation, performs a flushing operation while the nozzle array 107 and the nozzle array 108 are performing recording or the like on a recording sheet P.

In other words, the flushing operation and the recording operations can be performed simultaneously, because the nozzle array 107 is still located in the marginless recording region 133 while the nozzle array 106 is located in the flushing region 132. Since the flushing region 132 is adjacent to the marginless recording region 133, a flushing operation can be performed efficiently. The efficiency of use of time by the entire recording apparatus 10 in connection with recording can be increased by performing a flushing operation efficiently in terms of time in the above-described manner.

Figure 12D:
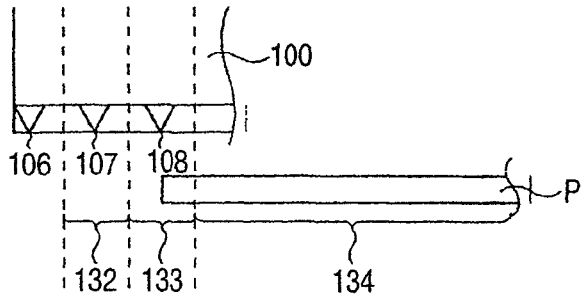

As shown in FIG. 12D, the nozzle array 106 stops the ink ejection when it has been moved to the left side of the flushing region 132. At the same, the nozzle array 107 performs a flushing operation at the flushing region 132, and the nozzle arrays 108 performs a marginless recording operation at the marginless recording region 133.

Then, whether the recording has completed is judged (step ST6). That is, the recording is finished by referring to the data in the printer driver 14.

Figure 13:
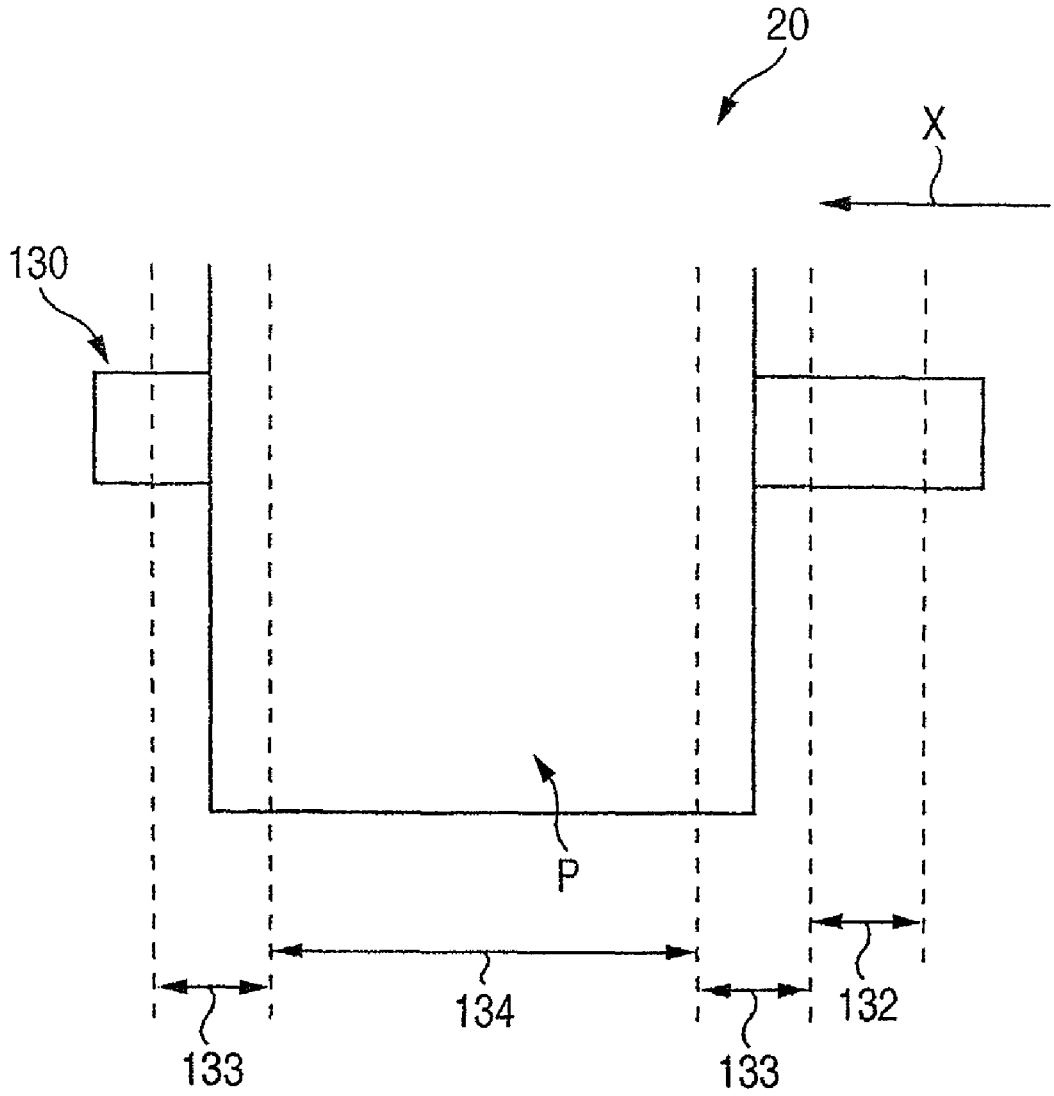
FIG. 13 is a diagram showing arrangement of a recording region, marginless recording regions and a flushing region in an ink jet recording apparatus according to a second embodiment of the invention.

FIG. 13 shows an ink jet recording apparatus 20 according to a second embodiment of the invention. Since most parts of the ink jet recording apparatus 20 is common to the corresponding parts of the ink jet recording apparatus 10 of the first embodiment, repetitive explanations for those will be omitted and differences will be mainly described.

In this embodiment, the flushing region 132 is located on the right side of the right-side marginless recording region 133. That is, a flushing operation is performed first in a recording operation for a single primary scanning.

Figure 14:
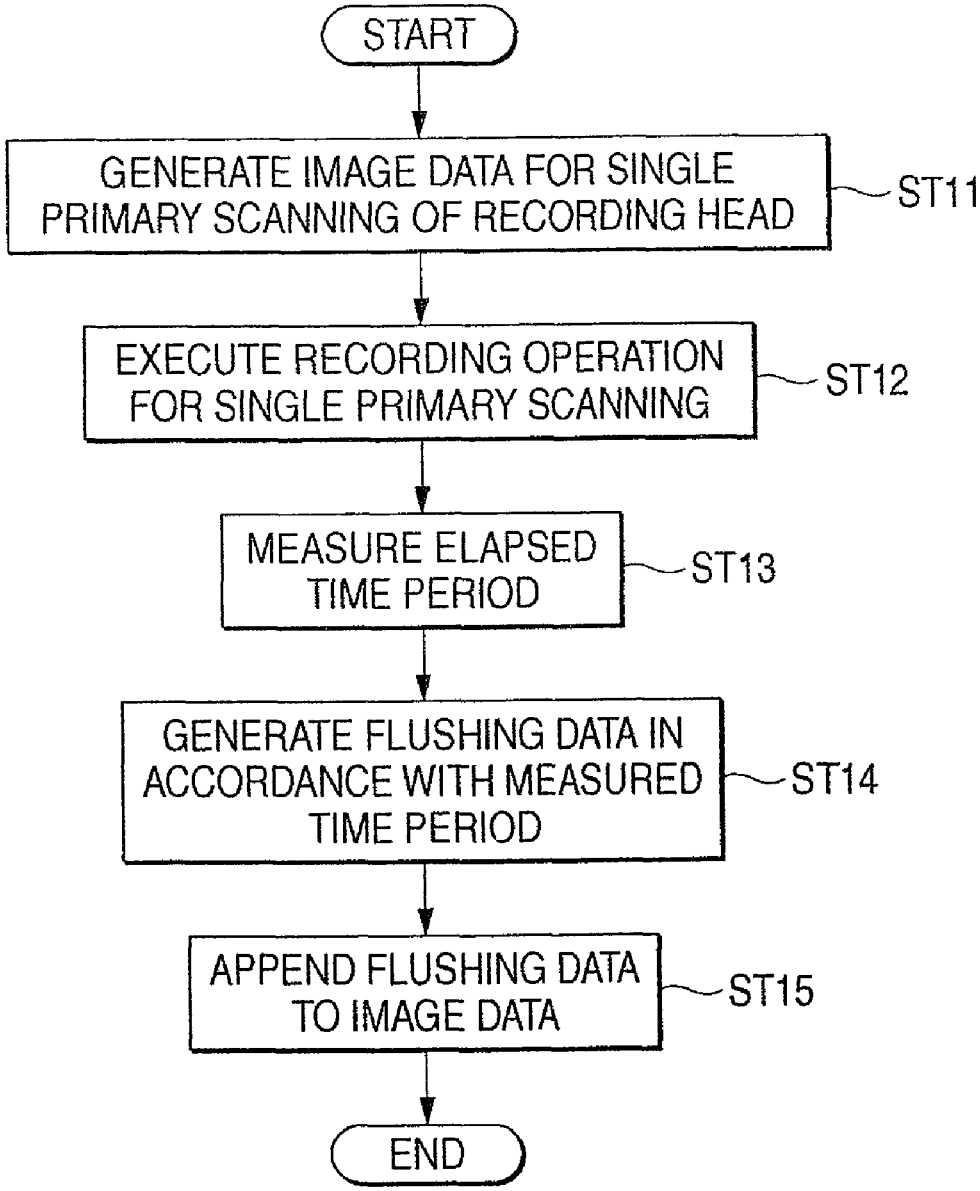
FIG. 14 is a flow chart showing operations performed by the ink jet recording apparatus of FIG. 13.

More specifically, as shown in FIG. 14, image data 250*a* (see FIG. 15) for a single primary scanning of the recording head 100 is generated (step ST11) and a recording operation with the image data 250*a* is performed (step ST12). This embodiment is different from the first embodiment in that an elapsed time T is measured by the timer 15 at step ST13.

An ink ejection failure or the like due to drying or the like of the nozzles 104 becomes more likely to occur as the time elapses. In view of this, in this embodiment, unlike in the first embodiment, the ink ejection amount is increased as the time elapses. In the first embodiment, a flushing operation is performed using the same ink amount every time the constant time elapses. On the other hand, in this embodiment, the ink amount is changed as the time elapses, whereby flushing operations are performed more effectively.

Figure 15:
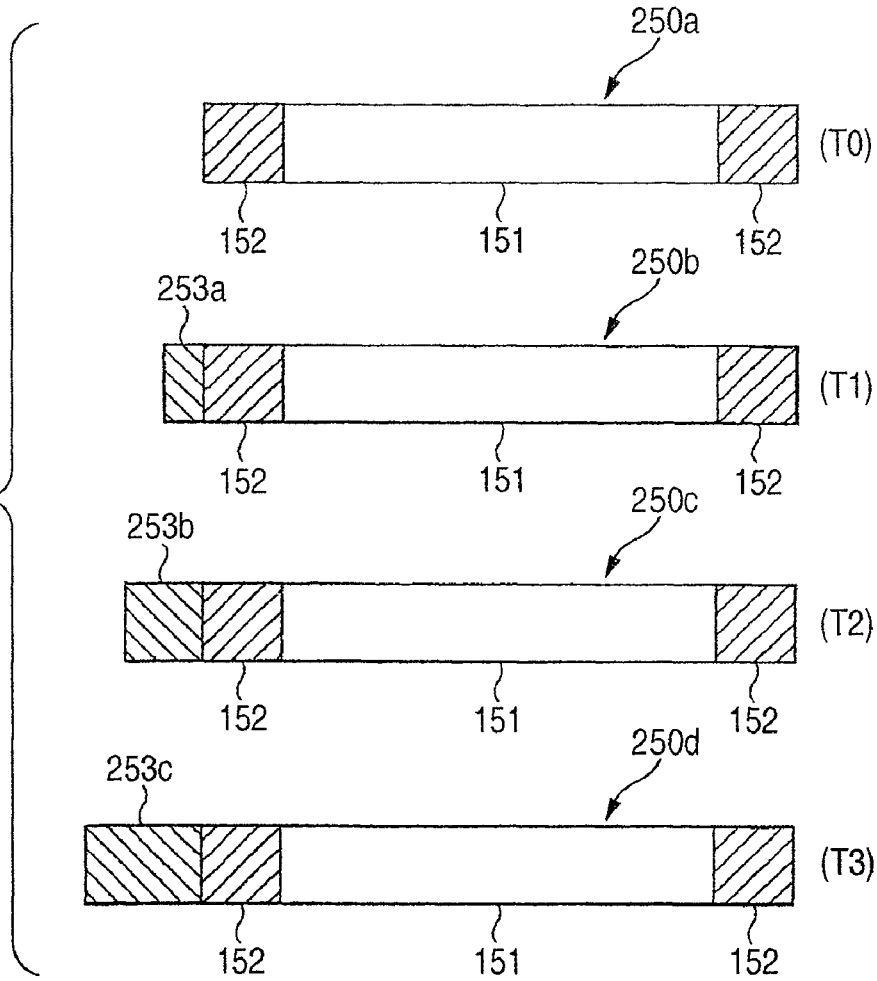
FIG. 15 is a diagram showing data structures of image data used in the ink jet recording apparatus shown in FIG. 13.

More specifically, flushing data 253*a* is generated on the basis of the measured elapsed time T (step ST14). Then, as shown in FIG. 15, second image data 250*b* is generated by appending the flushing data 253*a* to the image data 250*a*. Similarly, flushing data 253*b* and 253*c* are appended to the first image data 250*a* in order to respectively generate third image data 250*c* and 250*d* in accordance with the increase of the elapsed time T.

Therefore, the recording head 100 can perform, in the flushing region 132 shown in FIG. 13, a more effective flushing operation that is suitable for the degree of drying of the nozzles 104.

Figure 16:
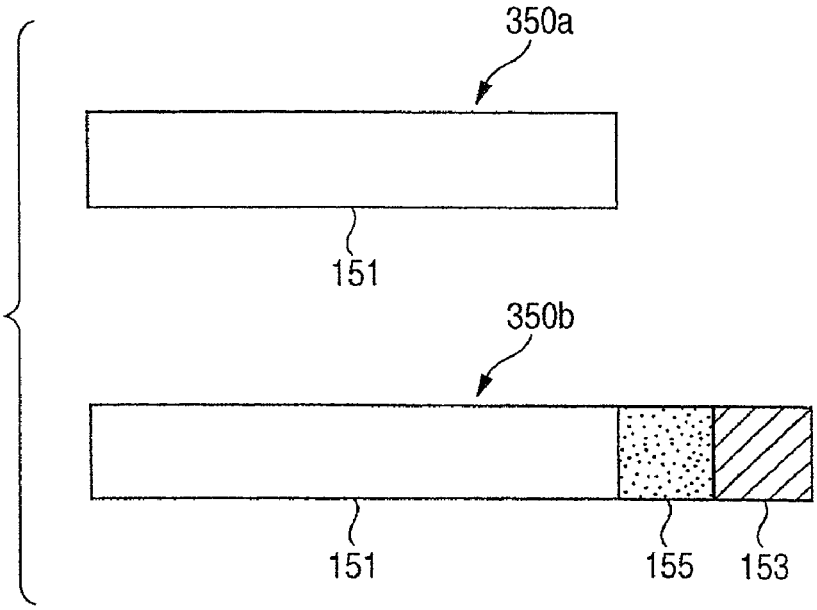
FIG. 16 is a diagram showing data structures of image data used in the ink jet recording apparatus according to a third embodiment of the invention.

FIG. 16 shows a third embodiment of the invention. Since most parts of this embodiment is common to the corresponding parts of the ink jet recording apparatus 10 of the first embodiment, repetitive explanations for those will be omitted and differences will be mainly described.

This embodiment is different from the first embodiment in that no marginless recording is performed. Therefore, unlike in the image data of the first embodiment shown in FIG. 8, first image data 350*a* does not include marginless recording data 152. In order to generate second image data 350*b*, flushing data 153 are appended to the first image data 350*a* with non-recording data 155 interposed in between.

In this embodiment, as the nozzle array 106 is moved outward from the recording region 134, ink ejection is halted during the passage of a blank region provided in place of the left-side marginless recording region 133 shown in FIG. 7 in accordance with the non-recording data 155. As the nozzle array 106 reaches above the flushing region 132, a flushing operation is performed with the flushing data 153.

Due to the time differences between image data set for the respective nozzle arrays 106 to 108, while the nozzle array 106 is performing the flushing operation in the flushing region 132, the nozzle array 107 stops ejecting ink droplets in accordance with the non-recording data 155 and the nozzle array 108 performs a recording operation with the recording data 151 at the recording region 134.

Since the flushing region 132 is not far from a recording sheet P as in the case of the first embodiment, the recording head 100 can perform a flushing operation quickly.

In addition, the flushing operation can be performed simultaneously with the recording operation. This makes it possible to perform a flushing operation efficiently.

Figure 17:
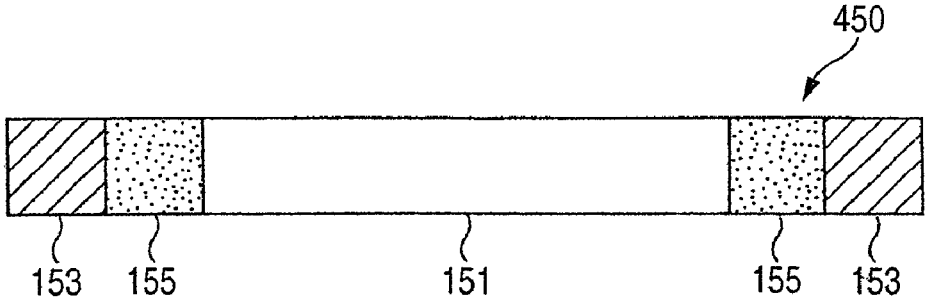
FIG. 17 is a diagram showing data structures of image data used in the ink jet recording apparatus according to a fourth embodiment of the invention.

FIG. 17 shows a fourth embodiment of the invention. Since most parts of this embodiment is common to the corresponding parts of the ink jet recording apparatus of the third embodiment, repetitive explanations for those will be omitted and differences will be mainly described.

In this embodiment, second image data 450 is generated by appending flushing data 153 at both of leading and trailing ends of the recoding data 151 while inserting non-recording data 155 between recording data 151 and the respective flushing data 153.

This arrangement of data also makes it possible to perform a flushing operation efficiently.

The invention is not limited to the above embodiments that are directed to the ink jet recording apparatus and various changes are possible without departing from the scope of the invention. And the above embodiments can be combined with each other.

Further, the invention is not limited to ink jet recording apparatus but can also be applied to, for example, liquid ejection apparatus using liquid ejection heads that include recording heads used for image recording apparatus such as printers, colorant ejection heads used for manufacture of color filters of liquid crystal displays etc., electrode material ejection heads used for formation of electrodes of organic EL displays, FEDs (field emission displays), etc., and bioorganic material ejection heads used for manufacture of biochips, and sample ejection apparatus as micropipettes.

What is claimed is:

1. A liquid ejection apparatus, operable to perform recording on a target medium, the liquid ejection apparatus comprising:

a liquid ejection head, being movable in a direction, and provided with a plurality of nozzles from which liquid droplets are ejected;

a first region to which the plurality of nozzles are operable to eject at least one liquid droplet toward the target medium based on a recording data being larger than a width of the target medium in data size in the direction, the recording data stored in a memory;

a second region to which the plurality of nozzles are operable to eject at least one liquid droplet toward an outside of the target medium based on the recording data;

a third region to which the plurality of nozzles are operable to flush a prescribed amount of liquid based on a data being different from the recording data in order to prevent an increase in liquid viscosity, the different data stored in the memory, wherein when a first one of the nozzles is positioned to flush the prescribed amount of liquid in the third region, a second one of the nozzles is positioned to eject at least one liquid droplet in the first region and a third one of the nozzles is positioned to eject at least one liquid droplet in the second region.

* * * * *